United States Patent [19]

Schnizlein, Jr.

[11] 3,930,699

[45] Jan. 6, 1976

[54] STACKABLE AND NESTABLE CONTAINER UNITS

[75] Inventor: John G. Schnizlein, Jr., Naperville, Ill.

[73] Assignee: Rosemary Schnizlein, Naperville, Ill.

[22] Filed: Feb. 6, 1975

[21] Appl. No.: 547,579

[52] U.S. Cl. ..... 312/108; 5/93 R; 5/9 R; 206/505

[51] Int. Cl.[2] ..... B65D 21/06; F16B 12/00

[58] Field of Search ..... 5/2 R, 9 R, 93; 297/440, 297/239, 108; 312/111, 114, 117; 206/505, 507

[56] References Cited

UNITED STATES PATENTS

| | | | |
|---|---|---|---|
| 2,774,511 | 12/1956 | Menkin et al. | 206/507 |
| 3,334,942 | 8/1967 | Breslow | 297/239 |
| 3,368,856 | 2/1968 | Tisdall et al. | 312/111 |
| 3,834,776 | 9/1974 | Becker, Jr. | 312/108 |

*Primary Examiner*—Casmir A. Nunberg
*Attorney, Agent, or Firm*—Burmeister, York, Palmatier, Hamby & Jones

[57] ABSTRACT

A sequence of containers of equal width and rectangular form with flat horizontal bottoms and flat vertical sides and ends can be placed in sequence one directly above another to form a self-supporting stack of vertically expanded height. By reversing the sequence, the containers can be placed one directly above another to form a self-supporting nest of collapsed height. The individual containers are symmetrical in shape both longitudinally and laterally and, except for incremental differences in length, can be identical in construction. The end-to-end relationship of successive containers can be the same for both stacking and nesting or individual containers can be turned end-for-end at will for either stacking or nesting. The compressive strength of the end panels provides strong support for either stacked or nested containers through upper and lower integral abutments on the end panels which fit against the side panels of underlying containers, when nested, and overlying panels, when stacked. When stacked or nested, adjacent containers are locked against relative longitudinal displacement by overlapping end panels and are locked against relative lateral displacement by end panels fitting between side panels of adjacent containers. The containers are easily adapted to serve as a wardrobe and play beds for dolls, being fully enclosed when nested and laterally open when stacked.

4 Claims, 7 Drawing Figures

Fig. 1.
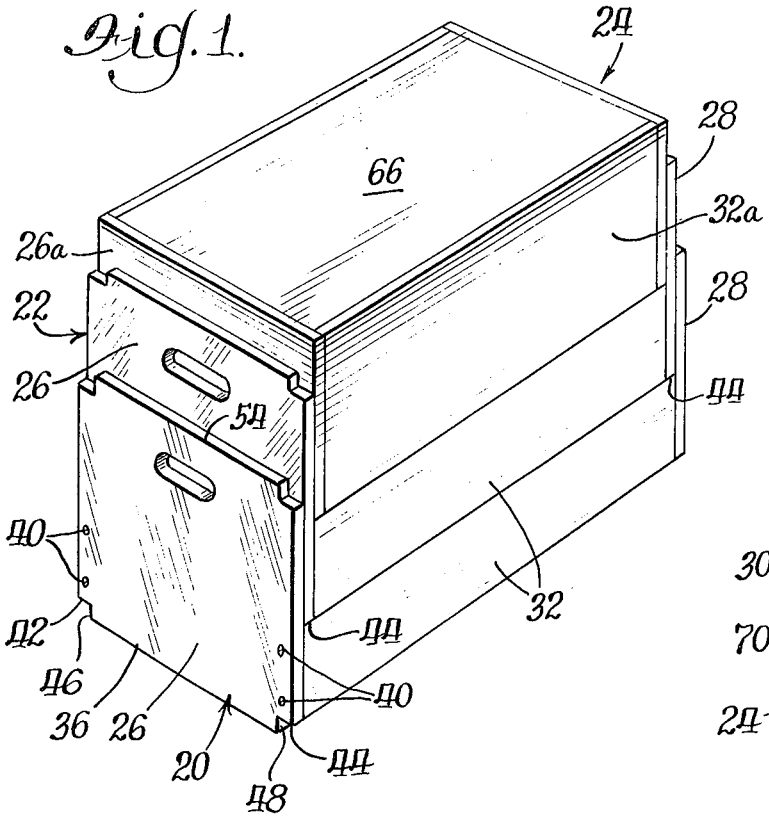
Fig. 2.
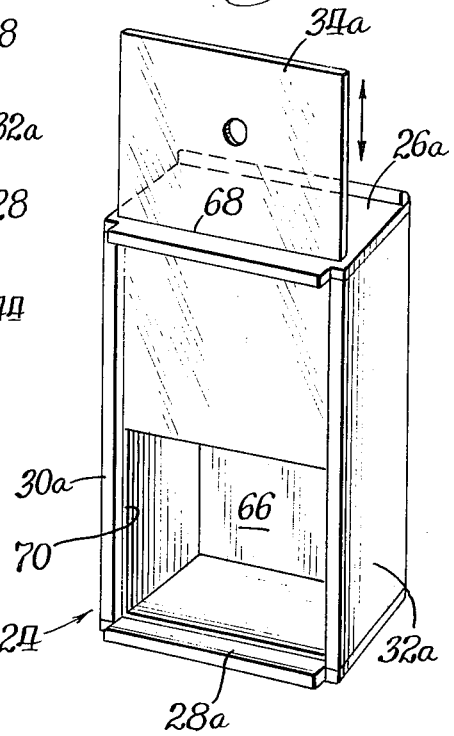
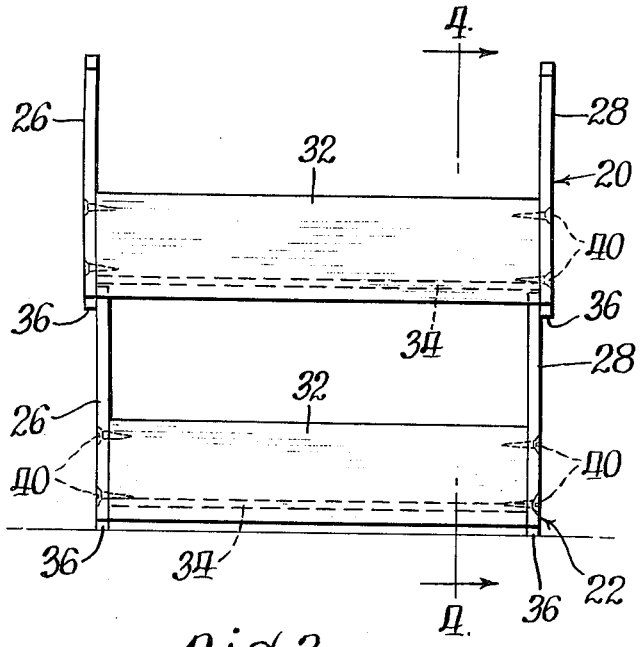
Fig. 3.
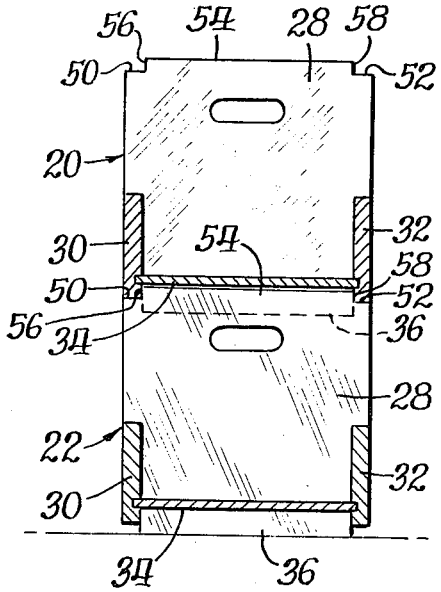
Fig. 4.

STACKABLE AND NESTABLE CONTAINER UNITS

The present invention relates to a stackable and nestable assembly of container units usable for a variety of purposes and being particularly adapted for children's use as doll storage and bedding furniture.

One object of the invention is to provide stackable and nestable containers that are so devised that the containers can be uniform in width and rectilinear in form with nontapering vertical sides and ends while at the same time being stackable in sequence to constitute a self-supporting stack vertically expanded to provide lateral exposure between tiered containers; the same containers being mutually nestable one on top of another in a reversed sequence to form a tiered self-supporting nest of collapsed height.

Another object is to provide as assembly of stackable and nestable containers as recited in the previous object in which nontapering containers individually having a flat bottom, two vertical side panels and two vertical end panels are mutually supported strongly in either nested or stacked relation to each other and positively locked against relative displacement in any lateral direction by an inherently strong interlocking relationship of the side and end panels.

Another object is to provide a sequence of stackable and nestable containers as recited that have the same end-to-end relationship to each other when stacked together as when nested together.

A further object is to provide a sequence of stackable and nestable containers as recited in the preceding objects which are capable, when tiered together, of mutually supporting each other with great strength by virtue of an integrated design of the containers which reduces bending stress on the container structure to an inconsequential value and uses the inherently strong compressive strength of the side and end panels of the containers for container support.

Another object is to provide a sequence of containers as recited in which extremely simple side and end panels, stressed by loads essentially compressive, support the mutually tiered containers, lock the containers against relative lateral displacement, and provide, when the containers are stacked, access to the containers from the side.

A further object is to provide a sequence of stackable and nestable containers as recited in the preceding objects which are individually self-supporting and separately usable.

A more specific object is to provide a sequence of stackable and nestable containers according to the preceding objects, which are particularly well suited for advantageous use as a series of doll beds.

Still another object is to provide a sequence of stackable and nestable containers as recited, which are particularly well adapted to serve as a wardrobe for doll's clothing and as beds for dolls. A related object is to provide containers as recited which function, when nested, as a dust excluding enclosure for dolls, doll bedding, and clothing.

Other objects will appear from the following description of the invention as illustrated in the accompanying drawings, in which:

FIG. 1 is a perspective view showing in mutually nested relation a sequence of containers embodying the invention;

FIG. 2 is a perspective view showing the underside of the top container of FIG. 1 positioned on end in FIG. 2 with the bottom panel retracted to expose the interior;

FIG. 3 is a side view showing the two lowermost containers of FIG. 1 tiered together in reversed sequence to form a stack;

FIG. 4 is a vertical sectional view of the stacked containers taken with reference to the line 4—4 of FIG. 3, and showing the interlocking relationship of the side and end panels;

Figure 5:
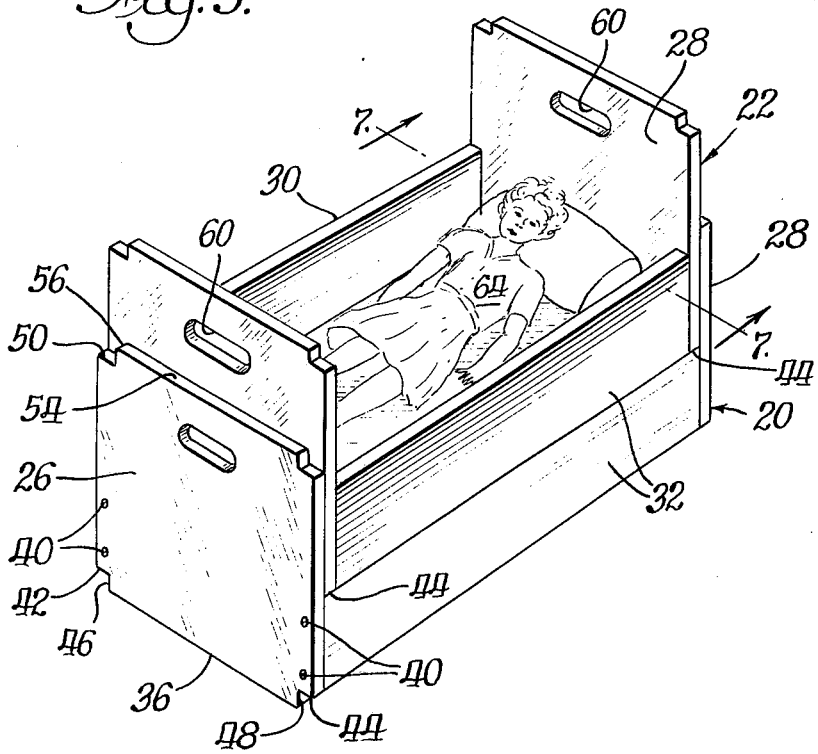
FIG. 5 is a perspective view of the two lowermost containers as nested together in FIG. 1 but with the covering container removed to reveal a doll bedded in the upper containers left exposed.

Referring to the drawings in greater detail, the preferred embodiment of the invention depicted for the purpose of illustration is designed for use by children as furniture for bedding and storing dolls and clothing for dolls. The exact number of containers provided for this purpose in a sequence is determined by the needs and preferences of the user and not by way of any practical limitation imposed by the principles of the invention.

For efficiency in the utilization of space available for the patent drawings, a sequence of only three containers 20, 22, 24 is shown. These three, embodying the invention, adequately illustrate its principles, it being understood that the sequence can be expanded in number as desired.

Each of the containers, as exemplified by the containers 20, 22, 24 has a rectilinear form overall. As typified by the container 20, which will be described in detail, each container is formed by two nontapering vertical end panels, 26, 28, two nontapering vertical side panels 30, 32 and a flat bottom or bottom panel 34, FIGS. 3 to 7. Thus, each container, like the container 20 has a nontapering uniform length from bottom to top and a nontapering uniform width from bottom to top. Moreover, all of the containers 20, 22, 24 have the same width.

In fact, except for the uppermost container 24 shown in FIG. 1 and illustrated in FIG. 2, which is especially adapted to serve as a wardrobe for a doll's clothing, all of the containers in the sequence are essentially identical, except for incremental differences in length.

Being of uniform width, the containers differ successively in length by a length differential which exceeds the combined thickness of the two end panels 26, 28 of an individual container by only the very slight working clearance requisite to easy movement of the end panels of successive containers into and out of overlapping relation to each other as the containers are tiered together.

The two end panels 26, 28 of the typical container 20 are substantially identical, being mirror images of each other. As shown in FIGS. 1, 4, 5, and 7, the lower marginal edge of the end panel 26 is shaped to define a lower support and locking tang 36, projecting downwardly below the lower edges of the two side panels 30, 32 of the container.

Figure 7:
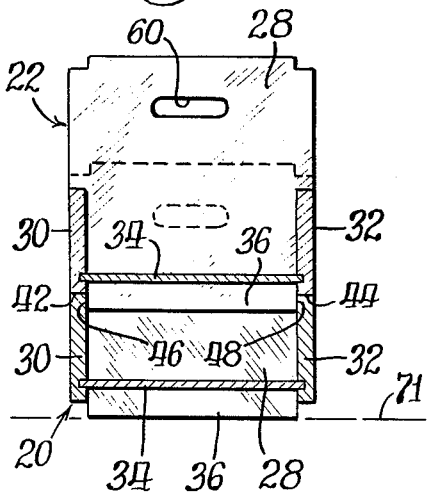
FIG. 7 is a vertical sectional view taken with reference to line 7—7 of FIG. 5 and showing the relationship of interlocking side and end panels when the containers are tiered in mutually nested relation.

The lower tang 36 extends transversely across the underside of the container and terminates at opposite ends just short of the internal vertical faces of the two side panels 30, 32 of the container, so that the depending tang 36 will just fit easily between the side panels of an underlying container when the containers are nested together, FIG. 7. As will appear, each tang 36 projects below the underside of the adjacent side panels 30, 32 sufficiently to form a reliable positive interlock with the side panels of an underlying nested container, and for this purpose, the extent of the downward projection of the individual tang 36 can be of the order of the thickness of an end panel 26, 28.

In the preferred construction illustrated, each container end panel 26, 28 overlaps the adjacent ends of the two side panels 30, 32 of the container to which the end panels are secured by screws 40 or other suitable fasteners.

Two container support shoulders or abutments 42, 44 are formed on each end panel 26, 28 at the base of the tang 26 and in generally coplaner, flush relation to the undersides of the adjacent side panels 30, 32, FIG. 1. These abutments 42, 44 are designed, as will appear, to rest on the upper edges of the side panels 30, 32 of an underlying container, when the containers are nested, to support the overlying container, FIGS. 1 and 5.

The lower portion of each end panel 26, 28 is most conveniently fashioned to define the two lower support abutments and the lower tang 36 by notching the two lower corners of the end panel as shown, FIG. 1, to define the abutments and tang. Preferably, the lower corner notches cut to define the abutments 42, 44 and tang 36 should be substantially square so that the abutments 42, 44 are horizontal and the two lateral extremeties of the tang 36 define two substantially vertical abutments 46, 48 which lock nested containers against horizontal displacement, FIG. 7.

Similarly, the upper ends of each end panel 26, 28 are shaped to define as counterparts of the lower horizontal support abutments 42, 44 upper support abutments 50, 52, located a common vertical level at the two upper corners of the end panel and extending horizontally inward to receive and support the undersides of the side panels of an overlying stacked container, FIG. 4.

Between the two horizontal support abutments 50, 52 the upper marginal edge of each end panel 26, 28 is shaped to define an upwardly projecting tang 54 running horizontally across the container and defining adjacent the respective support abutments 50, 52, a pair of substantially vertical abutments 56, 58 disposed inwardly of the inner faces of the respective side panels 30, 32 just sufficiently to fit smoothly between the side panels of an overlying stacked container, FIG. 4. The vertical extent of the upper tang 54 and the two vertical abutments 56, 58 at opposite ends of the tang is sufficient to form a positive interlock with the side panels of an overlying stacked container and may be of the order of the thickness of an end panel 26, 28.

To accommodate the upwardly projecting tangs 54 of an underlying stacked container, FIG. 3, the bottom panel 34 of each container is mounted on the container side at end panels to occupy a horizontal position therebetween which is vertically positioned above the lower edges of the side panels. This provides a vertical clearance space between the undersurface of the bottom panel 34 and the lower edges of the side panels 30, 32 for receiving between the bottom panel and the lower edges of the side panels and upwardly projecting tang 54 of an underlying stacked container, FIG. 4.

As previously described, the lower edges of the side panels are substantially flush with the support shoulders or abutments 42, 44 of the adjacent end panels. The vertical width of the side panels 32, 34 is, however, much less than the vertical width of the end panels 26, 28 between the lower abutments 42, 44 and the upper support abutments 50, 52, thus enabling the containers when nested, FIGS. 5 and 7, to have a greatly reduced overall height in relation to the expanded height of the stacked containers, FIGS. 4 and 6.

In the preferred construction illustrated, in which the containers are adapted for advantageous use as doll bed furniture, the vertical height or width of the side panels 30, 32 is approximately one-half that of the end panels, 26, 28. As shown, hand openings 60 are formed in the upper portions of the end panels, 26, 28 of the containers 20, 22 for convenient lifting of the containers.

As previously intimated, the sequence of containers illustrated are especially adapted for use by children as doll furniture, the two containers 20, 22 shown being used as beds for dolls, 62, 64. The shortest container 24 in the sequence illustrated is somewhat modified in construction in relation to the containers 20, 22 to serve as a closed wardrobe for doll clothing. Component elements of the container 24, FIGS. 1 and 2, corresponding to components of the containers 20, 22 previously described in detail are denoted with the same reference number with the addition of the suffix *a*. The side panels 30*a*, 32*a* are widened upwardly to extend all the way to the top of the end panels 26*a*, 28*a*, which are squared off at the top, as shown. The top of the container 24, in this instance, is covered by a top panel 66, secured to the side and end panels.

The bottom panel 34*a* of the container 24 is slidably supported in a slot 68 in the end panel 26*a* and in a U-shaped support groove 70 formed in the side panels 30*a*, 32*a* and end panel 28*a*, FIG. 2. Access to the interior of the container 24 is obtained by retracting the slidable bottom panel 34*a* through the end panel slot 68 as shown in FIG. 2. With the bottom panel 34*a* advanced back into its normal position, the container 24 forms a sturdy and essentially dustproof storage wardrobe for doll clothes and accessories.

As previously explained, the sequence of containers can be increased in number as desired, 5 or 6 being a highly satisfactory number for children's play furniture.

In use, the several containers can be separately placed and individually supported on most any upwardly facing support surface 71 of suitable width. When placed individually on an external support surface 71, each container is strongly supported by its lower tangs 36 resting on the surface.

The containers can be nested together for storage or for any other purpose in a packed assembly as illustrated in FIGS. 1, 5, and 7, by placing the longest container of the sequence on the bottom with successively shorter containers placed thereon, one above the other. When the containers are nested in this fashion, the side panels 30, 32 of the tiered containers are juxtaposed to provide a generally dustfree enclosure of the space within the containers.

Powerful support for the containers tiered in nested relation is provided by the compressive strength of the structure of the side and end panels at the container corners. The lower support abutments 42, 44 of each container deposited above another, rest squarely on the upper edges of the side panels 30, 32 of the underlying container, right at the container corners. By virtue of the flush relation of the abutments 42, 44 with the lower edges of the adjacent side panels 30, 32 the load of overlying containers is transmitted by the compressive strength of the side panels and the adjacent structure of the end panels down to the container below.

At the same time, the lower tangs 36 of each container tiered in nesting relation on another fit down between the side panels 30, 32 of the container below, FIG. 7. The vertical abutments 46, 48 on each lower tang 36 confront the inner faces of the side panels of the container below to lock the upper container against sideways displacement relative to the container below. At the same time, the upper portions of the end panels 26, 28 externally overlap the ends of the container nested above to preclude end-wise displacement of the containers relative to each other.

Figure 6:
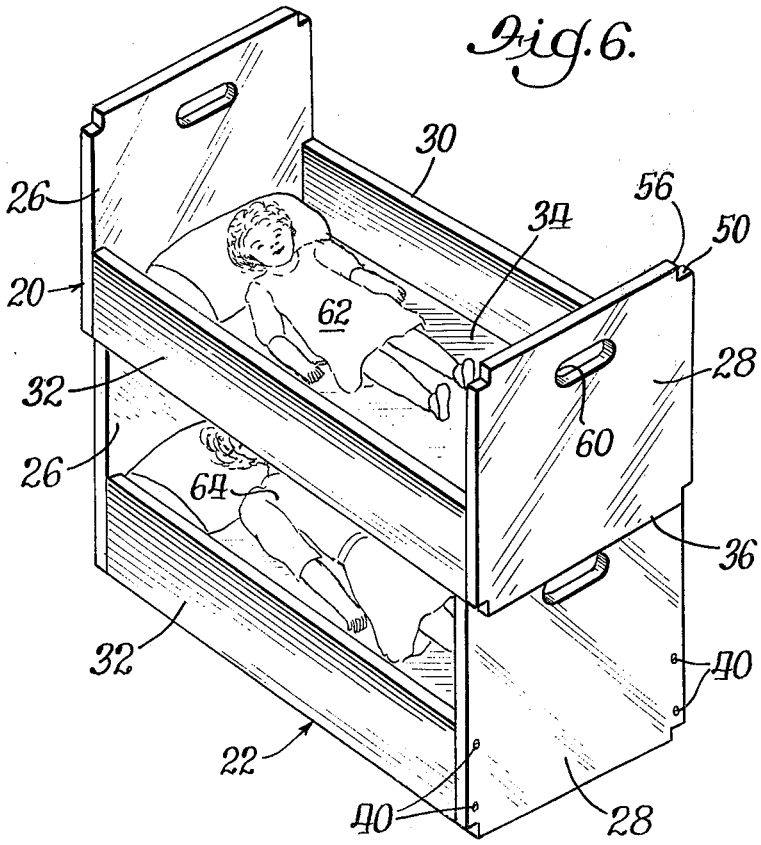
FIG. 6 is a perspective view of the two containers of FIG. 5 tiered, however, in a reversed sequence to form a vertically expanded stack.

For play with dolls or for use otherwise, the containers can be tiered together in a reversed sequence to form a vertically ascendent stack, FIGS. 3, 4, and 6. In this instance, containers of successively greater length are placed one above the other.

When tiered in stacking relation, the upper abutments 50, 52 on the end panels of the container below underly and directly support the lower edges of the side panels 30, 32 on the container above, using the compressive strength of the structure of the side end panels at the corners of the containers to support the overlying load.

At the same time the upper tangs 54 of the end panels 26, 28 fit upwardly between the lower marginal edges of the side panels of the container above, FIG. 4. The vertical abutments 56, 58 confront the inner faces of the side panels of the overlying container to preclude sideways relative displacement of the stacked containers. End-wise relative displacement of the stacked containers is precluded by the external overlapping relation of the lower tangs 36 of the overlying container with the upper ends of the end panels of the container below, FIGS. 3 and 4.

The invention is claimed as follows:

1. A stackable and nestable sequence of containers; each of said containers being rectangular in form and comprising two flat parallel end panels, two flat parallel side panels extending between the end panels in perpendicular relation thereto, and a flat bottom panel disposed between the end panels and between the side panels in proximate spaced relation to the lower edges of the side panels; said containers being of uniform width so that placement on one container on a parallel container below causes the side panels of the container above to directly overlie the side panels of the container below; said containers varying successively in length of differential longitudinal increments slightly exceeding the combined thickness of the two end panels so that placement of successively shorter containers on a parallel container below causes each container above to fit longitudinally between the end panels of the container below and which, conversely, causes each container below to fit longitudinally between the end panels of the container above when the containers are stacked in reverse sequence one above another; except for the longest container of the sequence, the two end panels of each container defining two lower support abutments substantially flush with the lower edges of the container side panels and facing downwardly to rest on the upper edges of the side panels of a longer container below; the lower portion of each end panel, except for end panels of the longest container, defining a pair of outwardly facing abutments extending downwardly from the adjacent lower support abutments to fit between the side panels of an underlying longer container to preclude relative lateral displacement of the containers; the end panels of containers, shorter than the longest container, projecting above the container side panels and defining respectively two upper support abutments facing upwardly in upwardly spaced and horizontally alined relation to the container side panels to fit against the lower edges of the side panels of an overlying longer container to support the latter in an elevated stacked relation to the lower container; and the upper portions of the end panels of containers, shorter than the longest container, defining respectively a pair of outwardly facing abutments projecting above the adjacent upper support abutments to fit betweeen the lower edges of the side panels of a longer container stacked thereabove to preclude lateral displacement of the containers.

2. A sequence of containers according to claim 1, in which the side panels of the shortest container are increased in width to extend substantially to the top of the container end panels and a generally flat top panel in mounted to extend between the side panels and between the end panels so that the shortest container constitutes an enclosure for a doll wardrobe and the like, the bottom panel of the shortest container being made slidably removable to afford access to the interior of the container.

3. A stackable and nestable sequence of containers; each of said containers being rectangular in form and comprising two parallel end panels, two parallel side panels extending between the end panels in perpendicular relation thereto, and a bottom panel disposed between the end panels and between the side panels; said containers being of uniform width so that placement of one container on a parallel container below causes the side panels of the container above to directly overlie the side panels of the container below; said containers varying successively in length by differential longitudinal increments slightly exceeding the combined thickness of the two end panels so that placement of successively shorter containers on a parallel container below causes each container above to fit longitudinally between the end panels of the container below and which, conversely, causes each container below to fit longitudinally between the end panels of the container above when the containers are stacked in reverse sequence one above another; end panels of the containers being shaped at the lower edge thereof to effect an overlying confronting relationship between the lower edges of the side panels of a container above and the upper edges of the side panels of an underlying longer container; the lower portion of each end panel of containers other than the longest container defining a pair of laterally facing abutments extending downwardly to overlap the side panels of an underlying longer container to preclude relative lateral displacement of the containers; the end panels of containers, shorter than the longest container, projecting above the container side panels and defining respectively two upper support abutments facing upwardly in upwardly spaced and horizontally alined relation to the container side panels to fit against the lower edges of the side panels of an overlying longer container to support the latter in an elevated stacked relation to the lower container; and the upper portions of the end panels of containers, shorter than the longest container, defining respectively a pair of laterally facing abutments projecting above the adjacent upper support abutments to overlap the lower edges of the side panels of a longer container stacked thereabove to preclude lateral displacement of the containers.

4. A sequence of containers according to claim 3 in which the side panels of the shortest container are increased in width to extend substantially to the top of the container end panels and a generally flat top panel is mounted to extend between the side panels and between the end panels so that the shortest container constitutes an enclosure for a doll wardrobe and the like, and one panel of the shortest container being made movable to afford access to the interior of the container.

* * * * *

PO-1050
(5/69)

UNITED STATES PATENT OFFICE
CERTIFICATE OF CORRECTION

Patent No. 3,930,699 Dated January 6, 1976

Inventor(s) Mr. John G. Schnizlein, Jr.

It is certified that error appears in the above-identified patent and that said Letters Patent are hereby corrected as shown below:

Column 5, Numbered line 52, after "placement", "on" should be "of";

Column 5, Numbered line 56, after "length", "of" should be "by";

Column 6, Numbered line 27, at the beginning of the line, "in" should be "is".

Signed and Sealed this

Nineteenth Day of October 1976

[SEAL]

*Attest:*

RUTH C. MASON
*Attesting Officer*

C. MARSHALL DANN
*Commissioner of Patents and Trademarks*